US005431248A

United States Patent [19]

Willaughby

[11] Patent Number: 5,431,248

[45] Date of Patent: Jul. 11, 1995

[54] CONFINED SPACE LOWERING AND RETRIEVING APPARATUS

[76] Inventor: Donald Willaughby, Rte. 1 Box 791, Tickfaw, La. 70466

[21] Appl. No.: 140,445

[22] Filed: Oct. 25, 1993

[51] Int. Cl.[6] ..... A62B 1/08

[52] U.S. Cl. ..... 182/82; 182/142; 182/231

[58] Field of Search ..... 182/231, 142, 93, 82

[56] References Cited

U.S. PATENT DOCUMENTS 4,202,427 5/1980 Sada et al. ..... 182/142
4,589,523 5/1986 Olson et al. .
4,842,236 6/1989 Youts ..... 248/499
5,147,013 9/1992 Olson et al. .

*Primary Examiner*—Alvin C. Chin-Shue
*Attorney, Agent, or Firm*—Robert Montgomery

[57] ABSTRACT

Apparatus for use, in conjunction with a fall arrester or load winch means, when servicing a closed vessel having a top or side manway. The apparatus being adaptable for either exterior or interior mounting having universal, flexible supporting means. The apparatus further comprising a universal bracket means for operably receiving a fall arrester or load winch, mountable in a vertical position to the manway's cover flange.

15 Claims, 4 Drawing Sheets

CONFINED SPACE LOWERING AND RETRIEVING APPARATUS

FIELD OF THE INVENTION

The invention relates generally to the controlled suspension of personnel or materials inside a vessel and more particularly to the means for deploying such control equipment via the means of egress from a closed vessel and the raising or lowering of personnel or materials therein.

BACKGROUND OF THE INVENTION

Material hoist and fall arresting devices have been used for years for raising and lowering materials and retrieving stricken personnel from enclosed vessels. However, when such materials and personnel must access the vessel through a manway located in the side of such vessels, a great many problems arise. The primary problem being, how to achieve a mounting for hoist and fall arresters which will not impede access via the manway. Should the manway become blocked or impeded in any way, vital time could be lost when attempting to extract injured personnel. The same would be true if the fall arrester blocks the flow of materials through the manway.

One such device designed to overcome these problems has been disclosed by Olson et al. in U.S. Pat. No. 5,147,013. The Olson device provides a tripod arrangement, mounted on brackets which are further mounted to the manway cover flange. The Olson apparatus is dependent upon both upper and lower support members mounted on the manway. This arrangement is further dependent on a specific size of manway requiring adapters and the like which would further restrict access through the manway due to the horizonal mounting of the fall arrester and the location of the lower mounting member. The use of an outside roller mounted on the lower member, as described by Olson, is of no consequence since a working platform would normally be constructed just below the manway and would thus prevent the lowering of personnel or materials. The platform, extending into the vessel from the lower support as claimed by Olson, would also impede the decent of personnel attempting to climb down a ladder attached to the vessel wall. Olson further fails to provide a means for extending or retracting the tripod. Therefore, it would seem impractical to lower or hoist material directly over the worker and his only means of retrieval. Problems would also exist if an injured worker was being raised in an emergency situation whereby the tripod was extended some distance towards the center of the vessel. It would be extremely difficult to reach and retrieve the worker from the manway.

A fall arrester apparatus is also disclosed by Olson et al. in U.S. Pat. 4,589,523. Olson describes the structure and use of a tripod frame and arrester winch mechanism suspended over a vessel having a top mounted manway. There are several fundamental differences between the apparatus disclosed by Olsen and that of the present invention. The tripod arrangement of Olson has no means of attachment to the manway and is not intended for use inside the vessel. In this patent Olson concentrates on the fall arrester apparatus itself and its use in conjunction with the tripod frame. The arrester further depends on the frame for its mounting and support. The Olson apparatus is not adaptable for use inside the vessel and makes no provision for anchoring the arrester to the vessel in any manner.

It is, therefore, an object of the present invention to overcome the afore mentioned problems and provide a safe means for extracting personnel from an enclosed vessel having side access manways.

It is another object of the present invention to provide a more stable, quadruped structure for external vessel mounting which is adaptable to a tripod arrangement for inside mounting.

It is another object of the present invention to provide a universal mounting bracket, not dependent on the frame work for its support, which will receive most existing fall arresting and retrieval apparatuses.

Another object of the present invention is to provide a universal combination, fall safe mounting stand arrangement which works equally well for vessels with either side or top manways, regardless of the manway size.

SUMMARY OF THE PRESENT INVENTION

The present invention is a frame work apparatus, which works in cooperation with most fall arresting devices, for retrieving injured personnel from enclosed vessels having side or top access manways. The invention can further be adapted for use as a means for lowering or retrieving materials from inside enclosed vessels having side or top manways.

Recent safety codes for enclosed vessels discourages material hoisting with the same frame work as that utilized by the fall arrester. Therefore, the preferred embodiment of the invention addresses the need for maintaining the security of the fall arrester frame work by utilizing the upper most mounting bolts of the manway cover flange to vertically mount a fall arrester and bracket assembly. A short portion of the mounting bracket extends into the vessel's manway slightly beyond any interior ladder which may be provided and serves to support a pair of pulleys over which the fall arrester line is threaded. If no materials are to be passed through the manway, no further structure is required. However, if such materials are required, a light weight, stand-off frame can quickly be erected which will position the fall arrester safety line well clear of the manway.

The instant invention's improvement over the prior art being, a stand-off frame which is not bolted to the vessel's manway. Therefore, when used in conjunction with a vessel having a side manway, an adjustable belting is provided for suspending and securing a tripod type frame configuration inside the vessel in a manner which spreads the frame's legs above and below the manway while leaving the manway clear for passing materials.

The tripod frame work utilizes a rotatable screwjack for its upper leg and telescopic tubes for the lower legs. The legs are pivotal and are not fixed to a rigid support structure as is the prior art. Therefore, they are free to self-aline with the inside of the vessel wall. A cross member, located between the lower legs of the frame work, further provides a means of support for a rope ladder. When the frame work is required in conjunction with vessels having top manways, the screwjack and its associated bracket are simply replaced with a second pair of telescopically adjustable legs. The quadruped structure is then placed directly over the manway with the fall arrester line suspended from the central frame member. It is, therefore, evident that a similar arrangement could be employed for hoisting materials by simply substituting a stronger hoist for the fall arrester and stouter legs to support the required loads.

DETAILED DESCRIPTION OF THE PREFERRED EMBODIMENT

Figure 1:
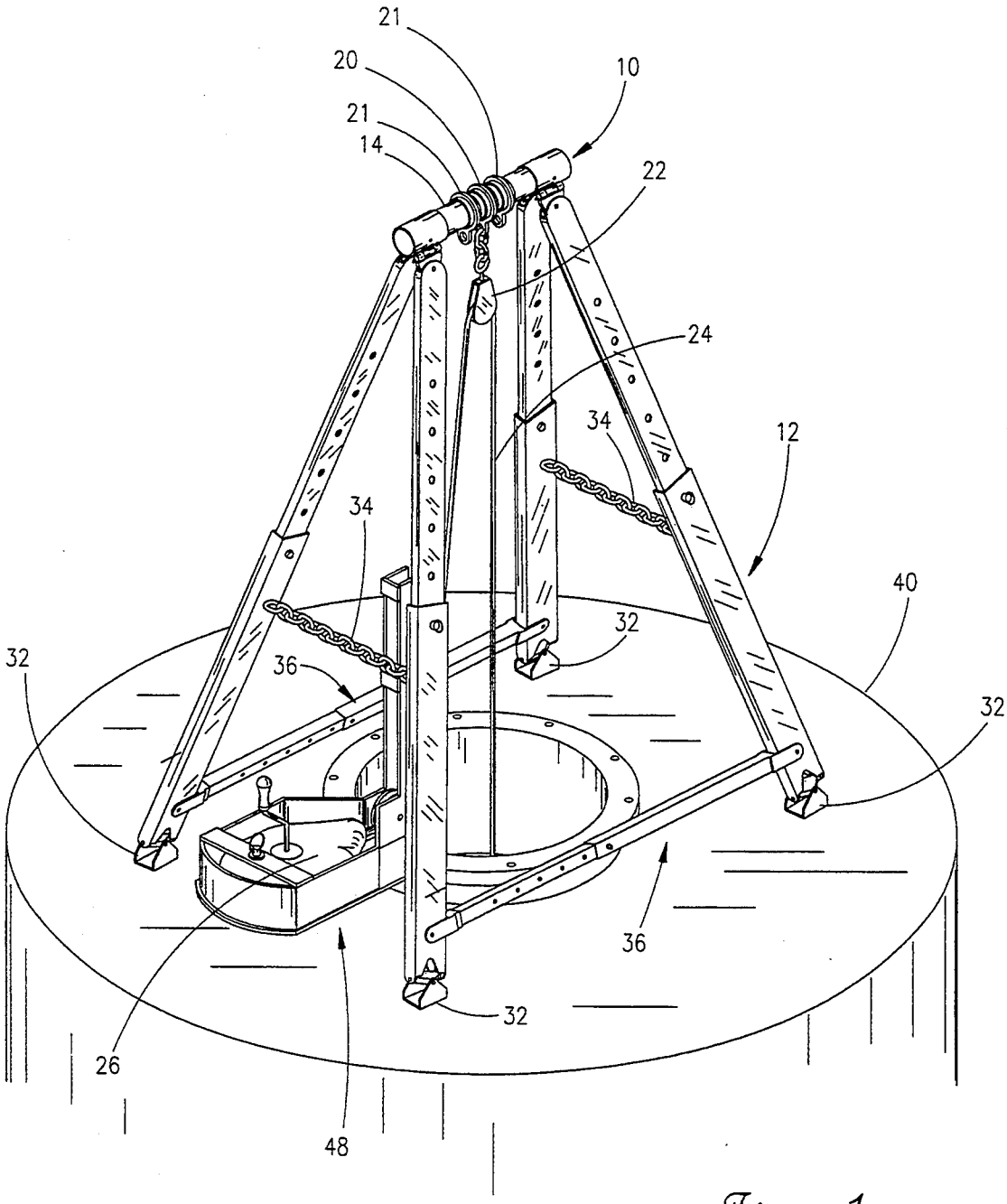
FIG. 1 is an isometric elevation view of the preferred embodiment as used on vessels with top mounted manways.
Figure 2:
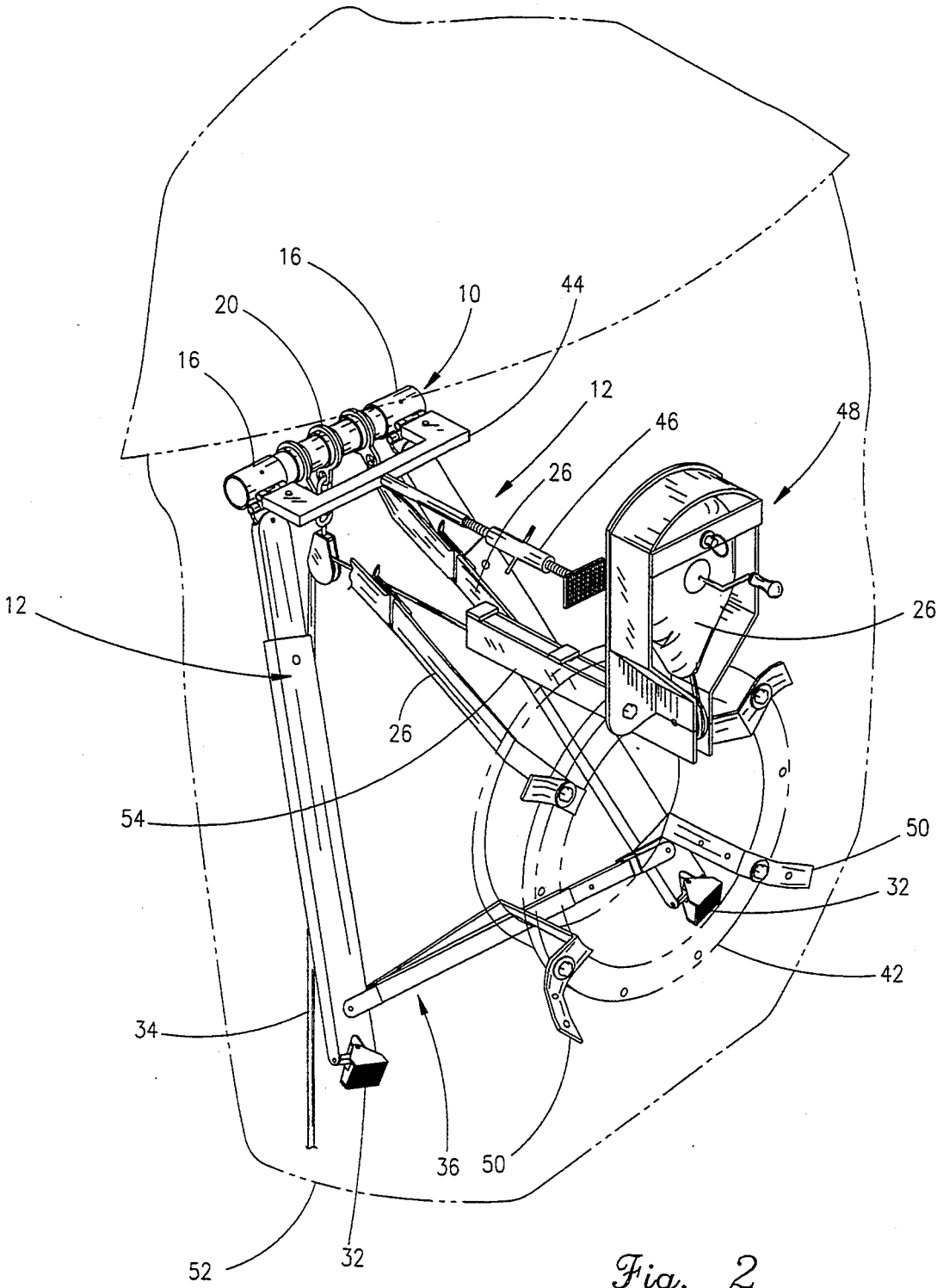
FIG. 2 is an isometric view of the preferred embodiment as used with vessels having a side mounted manway, shown with the vessel transparent.
Figure 3:
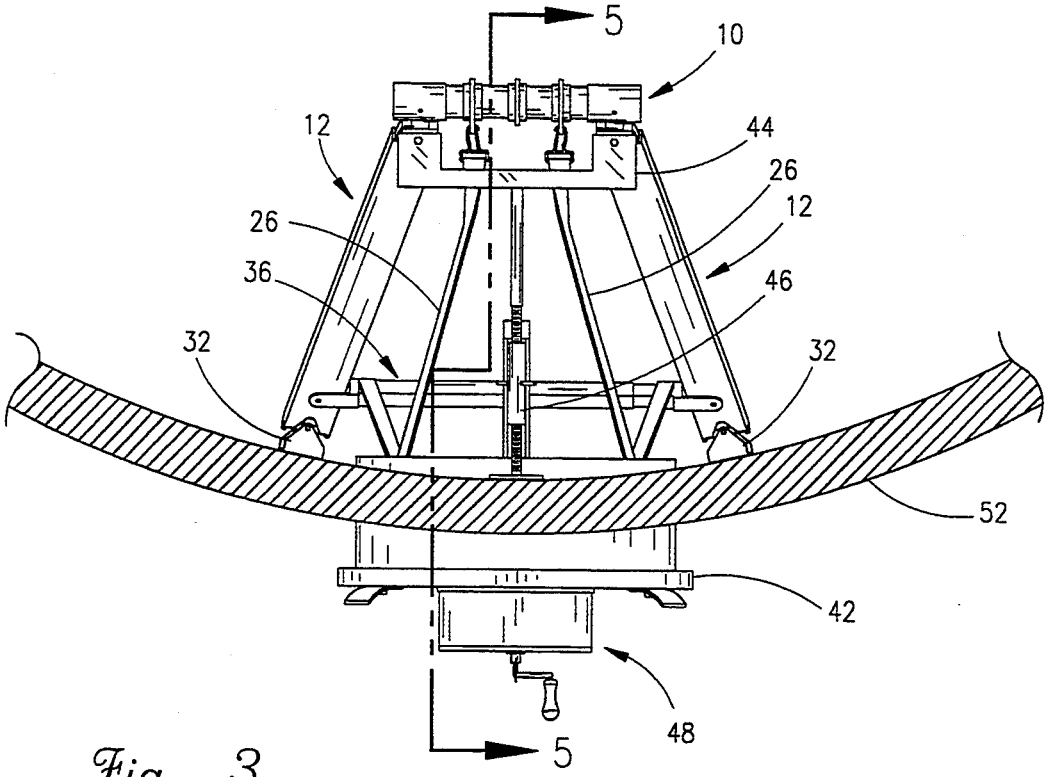
FIG. 3 is a plan view of the preferred embodiment as used with vessels having a side mounted manway.
Figure 4:
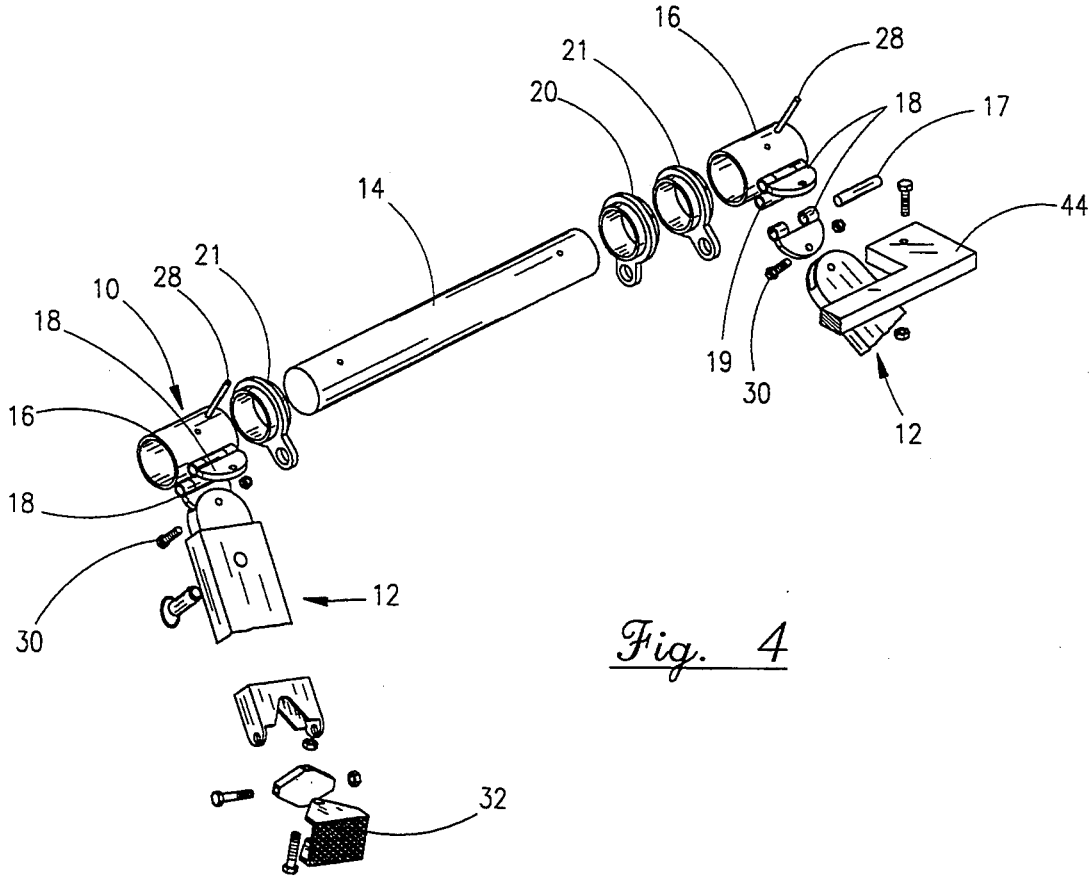
FIG. 4 is an isometric exploded view of the invention's central frame member showing connections for one leg assembly and the adaptor bar.
Figure 5:
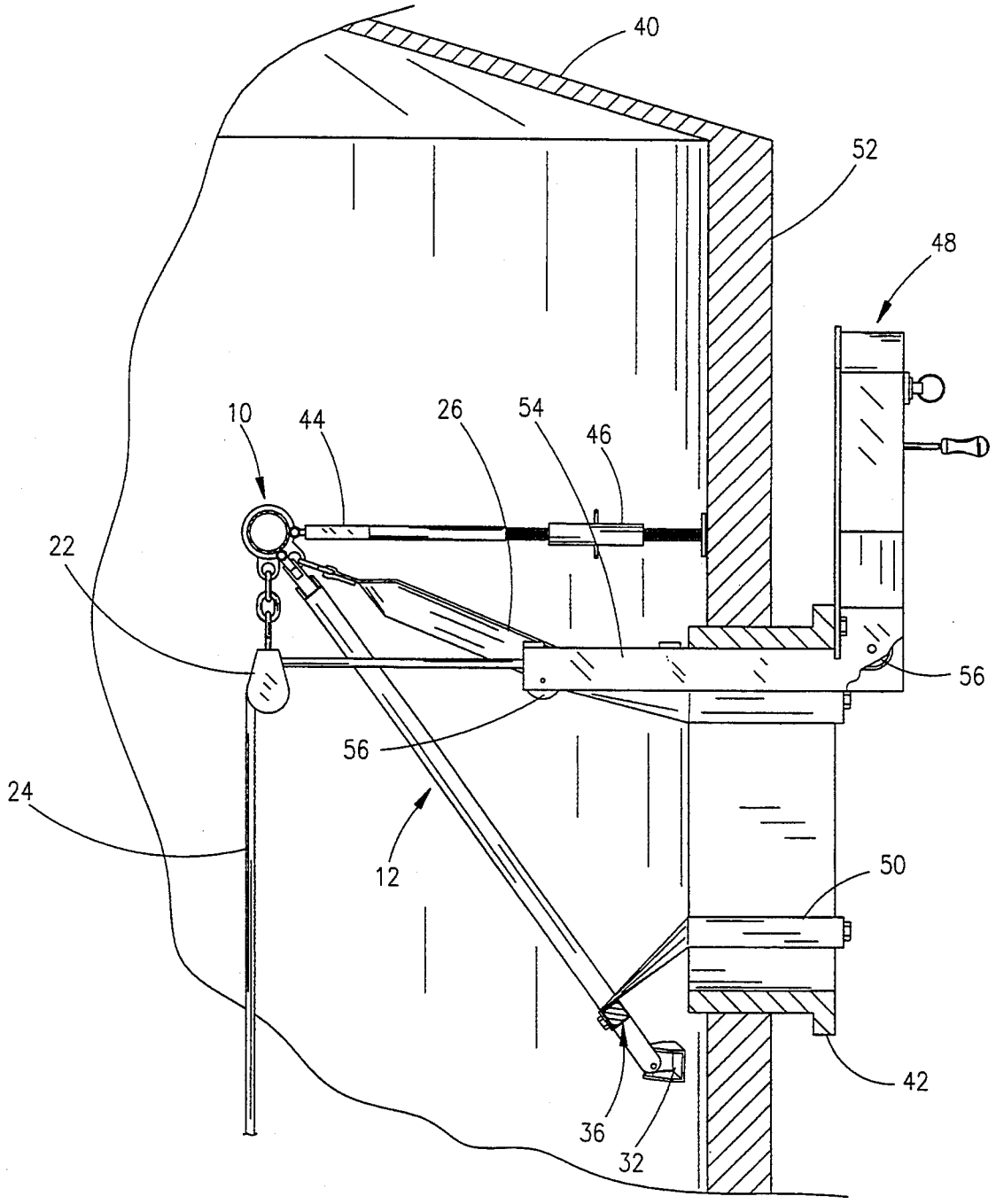
FIG. 5 is a sectioned side view of the vessel, exposing the instant invention as mounted in a vessel having a side mounted manway.

The preferred embodiment 1 of the present invention as shown in FIG. 1 utilizes a central frame member 10 and four telescopic legs 12. The central frame member as best seen in FIG. 4 comprises: a shaft member 14; a pair of detachable, leg hub members 16 also having pivotal leg tongues 18 attached thereto; and three rotatable eyelet hubs 20, 21. As seen in FIG. 1, the center most eyelet hub 20 located at the center of the shaft member 14, serves as a connection point for a snatch block 22 through which a line 24 from a fall arrestor or winch is threaded. The two eyelets 21 located adjacent the center eyelet 20 provide connection points for adjustable anchoring belts 26, as seen in FIGS. 2 & 3, which secure the entire frame 1 to the manway when used for side mounting. Each leg hub 16, detachably located adjacent the eyelets 21 at each end of the shaft member 14, is rotatable and secured to the shaft 14 by anchoring pins 28. Each leg hub 14 has two pivotal leg tongues 18 spaced diametrically apart for pivotally attaching the telescopic leg members 12. The leg tougues 18 are rotatably pined 17 to the leg hubs 16 via a tube 19 which is welded to the hub 16 to allow the legs 12, attached to each hub, to be spaced apart. The legs 12 are also pivotal about the bolt 30 to allow for lateral, pivotal rotation only. Thus, the legs 12 of each hub 16 are articulated in a manner that allows for bilateral rotation. Each leg 12 is also provided with pivotal feet 32 which allows for bilateral conformance to curved surfaces. Adjustable connection chains 34 are provided to laterally ajust the angle of the legs 12 extending from each hub 16. Adjustable spreader bars 36 are provided for adjusting the leg 12 spacing between hubs 16. When the frame 1 is to be used inside an enclosed vessel 40 having a manway 42 in its side, as seen in FIG. 2, two of the leg members 12 are replaced by an adaptor bar 44 as shown in FIGS. 2–4. A rotatable, adjustable screw jack 46 attached at the center of the adaptor bar 44 converts the quadruped frame 1 to a tripod arrangement as seen in FIGS. 2, 3 & 5. A mounting bracket 48 is also provided as part of the apparatus, as best seen in FIG. 2, for attaching a fall arrestor and retrieving winch 26. A similar bracket can be provided for mounting a material hoisting winch. The bracket 48 and the anchor belts 26 along with additional belts 50 serve to secure the frame work to the vessel's manway. These belts 26, 50 are secured to the annular flange of the manway 42 in a manner which provides the maximum access through the manway 42. When used inside an enclosed vessel 40, the frame work 1 is passed through the manway and held in close proximity with the vessel's wall 52 by the anchor belts 26 which are attached at one end by the eyelets 21 located on the central frame member 10 and secured to the upper portion of the annular flange of the manway 42. A second pair of belts 50 is attached at one end to the lower portion of the manway's annular flange 42 and at the opposite end of the leg spreader bar 36 attached between the two lower most legs 12 of the frame 1 as seen in FIGS. 2, 3 & 5. Therefore, with the adaptor bar 44 and screw jack 46 serving as the upper most leg extending horizontally from the central frame member 10, intersecting the vessel's wall 52 above the manway while the lower two legs 12 extend downward on the diagonal, intersecting the vessel's wall 52 below the manway. The uppermost leg, comprised of bar 44 and jack 46, can be rotatably adjusted to tighten the belts thereby providing a secure, structure projecting well inside the vessel 40. The fall arrester, winch bracket 48 is then mounted to the manway's annular flange 42 in a manner which positions the arrester winch 26 vertically so as not to impede access through the manway. The arrester bracket 48 is also provided with a channel 54 which extends through the manway having a set of pulleys 56 therein which guide the fall arrester line 24 through the manway. The arrester line 24 is then passed through a snatch block 22 attached to the center eyelet 20 of the central frame member 10 for attachment as a safety line to a worker. The bracket 48 is universal in nature to allow for suspension of almost any type of fall arrester 26. A similar bracket is also supplied for attachment of a winch means. The spreader bar 36 between the lower most leg members serves as an attachment means for the lower suspension belts 50 and for a rope ladder when no ladder exists inside a vessel.

When the frame 1 is used in conjunction with vessels having top mounted manways as seen in FIG. 1, the adaptor bar 44 is replaced with two additional telescopic legs 12. The frame 1 is then positioned above the manway, the fall arrestor 26 or material winch is mounted to the manway's annular flange with the bracket's 48 pulley channel 54 extending upwards, thereby allowing the winch line 24 to be threaded through the snatch block 22 attached to the center eyelet 21 of the central frame member 10 and ultimately passed through the manway. In some instances the fall arrester bracket 48 and its associated pulleys 56 may be used alone without the use of the main frame 1.

It is, therefore, contemplated that the invention described herein could be otherwise embodied and/or used in a different manner. It is, therefore, intended that the claims be construed to include alternative embodiments of the invention within the limits of the prior art and the scope of the claims recited herein.

What is claimed is:

1. A portable suspension apparatus for moving a load, such as personnel or materials, through an opening in an enclosed vessel and raising or lowering of said load inside said vessel comprising:

a) an enclosed vessel having a side wall defining the inside and outside of said vessel equipped with an annulus flange forming a manway;

b) a suspension apparatus, passable through said opening and erected within said vessel, further comprising;

a central frame member having means for attaching legs, pulleys and flexible members;

at least two telescopic legs pivotally attached at one end to said central frame member and a telescopic spreader member adjacent the opposite end holding said legs in a spaced apart relationship while said legs are braced against said vessel's inside wall below said manway;

an adaptor bar, attached to said central frame member;

a jacking means for extension and retraction, attached at one end to said adaptor bar the opposite end braced against said inside wall, above said manway;

a first set of at least two flexible members attached at one end to said central frame member their opposite end attached to said annulus flange; and a second set of at least two flexible members attached at one end to said spreader member their opposite end attached to said annulus flange;

c) a mounting bracket for operable receiving a fall arresting and retrieving cable hoist means adapted to said manway annulus flange;

d) a cable guide means for guiding said fall arresting and retrieving cable, including a pulley block attached to said central frame member, attached to said mounting bracket and extending through said manway; and e) an attachment means securing ends of said first and second flexible members to said annulus flange.

2. The apparatus of claim 1 wherein said central frame member further comprises:

a) a shaft member;

b) a leg hub detachably mounted at each end of said shaft member;

c) at least two leg attachments pivotally attached to each of said leg hubs; and d) a plurality of rotatable eyelet hubs interposed between said leg hubs.

3. The apparatus of claim 2 wherein said adaptor bar is attachable to one of said leg attachments on each leg hub for converting said leg means from quadruped arrangement to tripod.

4. The apparatus of claim 3 wherein said jacking means attached to said adaptor bar forms a leg means for adjustable tensioning said flexible members.

5. The apparatus of claim 4 wherein said mounting bracket further comprises a pulley means operably mounted for rotatable supporting a line means being wound into or unwound from said fall arrester and retrieval means.

6. The apparatus of claim 5 wherein said mounting bracket means is vertically mountable to the annular flange of a manway with said pulley means extending inside the manway.

7. The apparatus of claim 1 wherein said flexible members are flat belts passing through said manway, attached to said annulus flange via said attachment means thereby providing support for said suspension apparatus.

8. The apparatus of claim 1 wherein said leg means are telescopic and have bilateral pivotal feet.

9. The apparatus of claim 8 wherein said leg means are bilaterally adjustable.

10. The apparatus of claim 2 wherein said leg attachments have pivotal connections which allow for lateral rotation of said leg.

11. The apparatus as in claim 1 wherein said suspension apparatus comprises means for converting use on enclosed vessels having top manways by replacing said adaptor bar with two additional telescopic legs.

12. The apparatus as in claim 11 wherein said suspension apparatus is held suspendedly against said inside vessel wall by said flexible means in a manner whereby said legs are allowed to conform to said inside wall with two of said telescopic legs braced against said vessel's inside wall each located below and to each side of said manway and said jacking means braced against said vessel's inside wall above said manway.

13. The apparatus as in claim 12 wherein said suspension apparatus is flexibly attached to said manway in a manner which does not partially restrict passage of personnel or materials through said manway annulus.

14. The apparatus as in claim 1 wherein said telescopic legs are bilaterally adjustable relative to said central frame member and said vessel wall.

15. Apparatus for moving a load, such as personnel or materials, through a manway in the side of an enclosed vessel and the lowering, retrieving and fall arresting of such loads comprising:

a) an enclosed vessel having a side wall defining the inside and outside of said vessel equipped with an annulus flange forming a manway;

b) a load supporting means passable through said manway, and erected within said vessel;

c) a flexible suspension means attached to said load supporting means and to said manway;

d) an extension means attached to said load supporting means and to said side wall for tensioning said flexible means relative to said side wall;

e) a bracket and pulley means vertically attached to said annulus flange for operably receiving a hoist means;

f) a hoist removable mounted to said bracket and pulley means;

g) a snatch block removable attached to said load supporting means; and h) a line means extending from said hoist means via said pulley means passing over said snatch block for connection to said load within said vessel.

* * * * *